US005080363A

United States Patent [19]

Soong

[11] Patent Number: 5,080,363

[45] Date of Patent: * Jan. 14, 1992

[54] SPORTS EQUIPMENT WITH ENHANCED FLEXIBILITY

[76] Inventor: Tsai C. Soong, 1839 Jackson Rd., Penfield, N.Y. 14625

[ * ] Notice: The portion of the term of this patent subsequent to Oct. 8, 2008 has been disclaimed.

[21] Appl. No.: 556,540

[22] Filed: Jul. 23, 1990

Related U.S. Application Data

[63] Continuation-in-part of Ser. No. 521,415, May 10, 1990.

[51] Int. Cl.[5] ..... A63B 53/00; A63B 53/08; A63B 49/00; A63B 59/00

[52] U.S. Cl. ..... 273/80 B; 273/67 R; 273/80 R; 273/73 J

[58] Field of Search ..... 273/80 R-80 D, 273/81 R, 73 G, 73 J, 75, 186 A

[56] References Cited

U.S. PATENT DOCUMENTS

| | | | |
|---|---|---|---|
| 603,694 | 5/1898 | Kavanaugh | 273/80 R |
| 1,968,616 | 7/1934 | Oldham | 273/81 R |
| 2,133,696 | 10/1938 | Hall | 273/81 R |
| 3,318,602 | 5/1967 | Kunihisa | 273/81 R |
| 3,638,943 | 2/1972 | Snauwaert | 273/73 J |
| 4,090,711 | 5/1978 | Amato | 273/80 R |
| 4,252,319 | 2/1981 | Lorang | 372/186 A |
| 4,811,947 | 3/1989 | Takatsuka et al. | 273/73 J |
| 4,979,743 | 12/1990 | Sears | 273/81 R |

*Primary Examiner*—Edward M. Coven
*Assistant Examiner*—Steven B. Wong
*Attorney, Agent, or Firm*—Bernard A. Chiama

[57] ABSTRACT

A sports equipment such as a golf club, for example, is described as having a handle, a head and a shaft connecting the handle to the head. The handle is formed as a hollow shaft segment into which a reduced diameter segment of the shaft, referred to as the central member, is inserted into the handle segment with sufficient clearance so as to allow relative movement therebetween during swinging of the sports equipment at play. The connection between the central member and the handle segment within the latter is provided by the use of at least one intermediate tube arranged to encircle the central member and with sufficient clearance to permit relative movement therebetween. One end of the tube is connected to the end of the member adjacent the butt end of the handle, while the other end is connected to the handle segment adjacent to the point wherein the central member enters the handle segment.

6 Claims, 8 Drawing Sheets

SPORTS EQUIPMENT WITH ENHANCED FLEXIBILITY

BACKGROUND OF THE INVENTION

This is a continuation-in-part of the patent application of the same inventor identified as Ser. No. 07/521/415, filed May 10, 1990. The present invention is applied to sports equipment having a long shaft which transmits, stores and releases, principally the bending strain energy, during the use of the equipment such that the play object, which in most cases, is a ball, can be driven, or thrown, to a desired distance. The flexibility of the shaft is, of course, important to the desired result. In later discussions, the golf club is taken as a sample to illustrate the invention, but the application is not limited to golf clubs. Such sports equipment, besides the golf club, include sports rackets, ballball bats and poles used for pole vault, and others, etc.

In golf, the driver is used to drive a golf ball to a large distance away. The golf club has a hollow, long and slender shaft with a handle on it and a head at the other end which is a solid mass made of wood, metal and other materials. The head is used to strike the ball at a high speed. The distance the ball can travel depends on its initial speed, and the initial angle of inclination of its trajectory with respect to the ground.

The head of the driver, more than 210 gm in weight, is much heavier than the shaft itself, which is about 100 gm. The handle is a part of the shaft, usually comprising a grip made of rubber, for the hand to hold. The purpose of having a heavy head is to have a large inertia mass to force the 42 gm ball to move quickly with minimum slowing-down of the head.

The shaft of the golf club is made of stainless steel tubing or fiber-reinforced plastics; its diameter is the largest near the handle and tapered down towards the head. The simplicity of the construction of the golf club shaft and its small diameter from end to end make any structural innovation about the shaft difficult. Head construction and better grip are two areas of activities for people in the trade, but almost nothing in terms of patents about the shaft per se could be found, except a U.S. Pat. No. 2,992,828 which is about a wire inside the shaft to compensate for the eccentricity of the head. The trend regarding ways to increase the head velocity is to use more sophisticated material, like fiber-reinforced composite material, to construct a shaft which is light, strong and very flexible. Flexibility enables the shaft to be bent backward severely and subsequently to swing the head forward to regain its straightness. This action produces a faster head speed than a less flexible shaft can. However, a shaft which is too flexible, especially when most of the bending in the shaft is being created closer to the head, would become difficult to control and difficult to hit the ball squarely at the head. This is a basic design concern of prior art with respect to the structure of the shaft of the golf club.

A. BENDING OF SHAFT AND STRAIN ENERGY. Through studies of the mechanics of driving a golf ball by a golf club, it is found that the flexibility of the shaft of the club is crucial to the velocity of the head in various ways. The flexibility enables the shaft to store bending strain energy in the shaft during its downward swing, then at the later part of the trajectory, the bent shaft begins to straighten up which propels the head to move faster. In energy conservation terms, we say that its bending strain energy is being converted into the kinetic energy. When the stored bending strain energy of the shaft is completely transformed into kinetic enegy, the shaft regains its original straightness. The velocity of the head, at that instant, reaches the maximum. These bent shapes change will be shown later in FIG. 10A. obtained through a rigorous computer study. The recovery is time-dependent and there is a natural frequency of the shaft associated with the swinging back-and-forth movement of the head mass. At the instant of hitting the ball, the head mass is preferred to be at its maximum speed which requires the shaft becoming straight and all the bending strain energy turned to kinetic energy. This takes a split-second timing and practice. The invention seeks a way to influence the forced vibration of the system, store more bending strain energy in the drive, and thereby increases the kinetic energy available to the moving head in the downward stroke.

DESCRIPTION OF THE DRAWINGS

For the purpose of illustrating the invention, there is shown in the drawings forms which are presently preferred, it being understood, however, that this invention is not limited to the precise arrangements and geometries shown.

DESCRIPTION OF THE PREFERRED EMBODIMENTS

The invention is not possible without a study how the golf club is swung, bent and hitting the stationary ball. A golf ball is designed to absorb the impact from the club head and store compressive strain energy. It deforms and compresion is developed. The compressive force in the deformed ball will accelerate the ball. As the ball is recovering from the compression, it will be accelerated and moves faster. Finally, the compression is completely tranformed into kinetic energy and the ball is no longer deformed. After that, there is no contact force transmitted, the ball flies away at a much larger velocity than the velocity of the head. Since the ball is initially at rest and is being hit suddenly by the speeding club head, it will be very quickly compressed solid and in a very short time propelled to move at the same speed as the club head. The total contact time is less than two thousandth of a second, but the impact energy stored is so great that when it is all transformed into kinetic energy, the ball would reach a much higher speed than the speed of the club head. It can be proved by analysis that, with no impact energy loss, the ball flies away at twice the speed of the club. This phenomenon is important to the understanding of the strain energy built-up in the shaft that supplies the large head speed to drive the ball.

Figure 1:
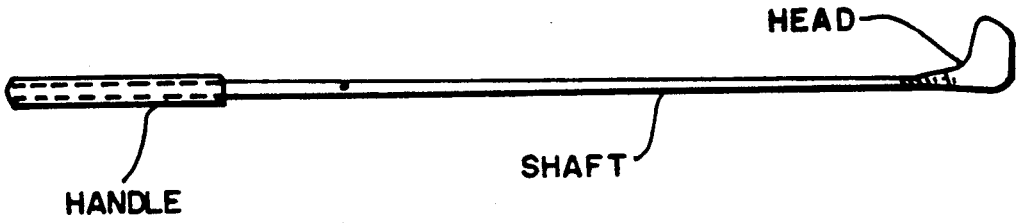
FIG. 1 shows a conventional golf club.

FIG. 1 shows the geometry of a conventional golf club. The shaft extends into the rubber grip. The other end is attached to the head.

Figure 2A:
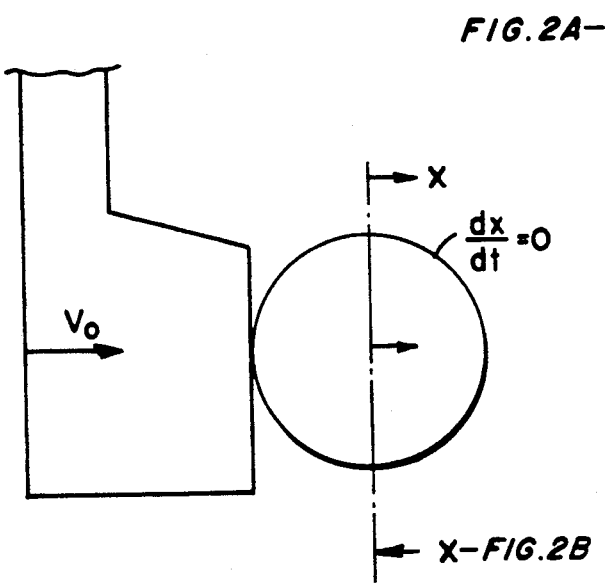
FIG. 2A shows the head of a golf club hitting a stationary ball; 2B shows the ball and head travel together for a distance X.
Figure 2B:
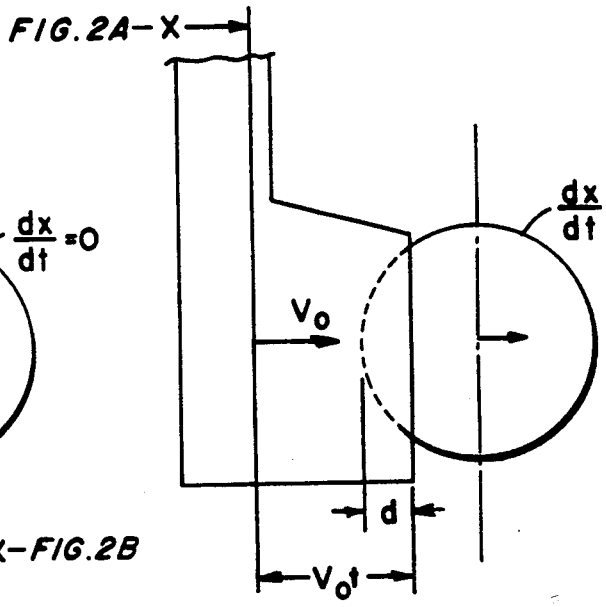

FIG. 2A shows that the club head is moving at a constant speed $V_o$, striking the stationary ball at time $t=0$. FIG. 2B shows the situation at a later time t when the head had moved a distance $V_o t$, the ball has been pushed to a distance X and its velocity should be [is at] dX/dt. The indentation of the ball, d, is $$d = V_o t - X \tag{1}$$

Figure 3:
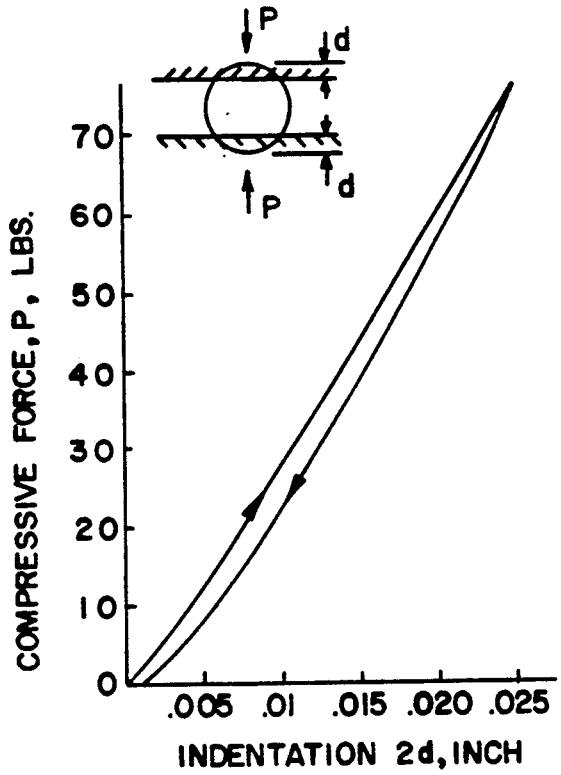
FIG. 3 shows test result of the force and indentation curve of the golf ball.

To derive the force required to compress the ball, a laboratory test of a golf ball under compressive force is needed. Such a data has been accurately obtained from a laboratory test. FIG. 3 shows the measured compressive force P on a golf ball at different amount of indentation d. The upper curve is the loading curve and the lower one is the unloading curve. The average slope P/d, denoted by s, is s=slope=285 kg/cm. Based on this test result, the force F and indentation d at any time can be expressed by the following linear relationship, $$F = s \times d \tag{2}$$

Newton's law $F=s\times d$ yields the differential equation of motion of the ball driven by the club head:

$$(W/g)(d^2X/dt^2) = (V_o t - X)s \tag{3}$$

where the ball's weight W is 42 gm. and g=gravity constant=980 cm/sec.$^2$.

The solution of Eq.(3) which satisfies the initial conditions of zero indentation and zero ball speed at time $t=0$, is $$X = V_o[(t - \sin((sg/W)^{\frac{1}{2}}t)/(sg/W)^{-\frac{1}{2}})] \tag{4}$$

and the corresponding velocity and acceleration equations are $$dX/dt = V_o[1 - \cos((sg/W)^{\frac{1}{2}}t)] \tag{5}$$

$$d^2X/dt^2 = V_o(sg/W)^{\frac{1}{2}} \times \sin[(sg/W)^{\frac{1}{2}}t)] \tag{6}$$

The total contact time t* and the flyoff speed V* can be calucalted as follows. In Eq. (6), the acceleration will become zero when the factor $\sin[(gt/W)^{\frac{1}{2}}t]$ vanishes. If at $t=t^*$ this term vanishes, then $$t^* = \text{contact time} = 3.1416/(285{,}000 \times 980/42)^{\frac{1}{2}} = 0.0012 \text{ sec.} \tag{7}$$

This is a very short impact time. During the entire period of contact, the travel of the ball from its stationary position to the fly-off point is, say X*, is obtained by Eq. (4), $$X^* = \text{contact distance} = V_o t^* = 0.0012\ V_o \text{ cm.} \tag{8}$$

The speed of the ball at the separation time t* is, from Eq. (5), $$V^* = dX/dt = V_o\{1 - \cos[(sg/W)^{\frac{1}{2}}t^*]\} = 2\ V_o \tag{9}$$

This equation shows the ball's speed is twice the speed of the club head. This knowledge is important with regard to what is the velocity of the head required to send the ball to a desired distance.

If the initial inclination angle of the trajectory is 45-degrees, the horizontal distance the ball can travel is, with $V_o$ as the speed of the club head, $$L_{max} = \text{travel distance} = V^{*2}/g = 4\ V_o^2/g \tag{10}$$

To have a realistic understanding of the magnitude of these quantities, let us take a golf player who hits the ball to a distance of 275 yard (275 m), i.e., $L_{max}$ in Eqs. (10) is 275 m. According to Eq. (10), the speed of the head, $V_o$, should be $$V_o = \text{initial velocity} = (27500 \times 980/4)^{\frac{1}{2}} = 2{,}590 \text{ cm/sec.} \tag{11}$$

With the club hitting the stationary ball at a speed of 25.9 m/sec. maintaining contact for only 0.0012 second, the club head and the ball will travel together only for a very short distance, given by (Eq. 8):

$$X^* = \text{contact distance} = 0.0012 \times 2{,}590 = 3 \text{ centimeter.} \tag{12}$$

The required head velocity, duration of contact with the ball and the distance they travelled together are important design information. It is clear that the head of the club should be heavy so that the momentum imparted to the ball will not slow down the head. At a head speed of 26 meters per second or more, It is difficult for a straight shaft of a length 100 centimeters to reach that terminal speed just by driving it hard. Here is the opportiunity of taking advantage of the vibration of the shaft. With an optimally flexible shaft with the inventrive enhancement, which transmits the increased bending energy to the kinetic energy, yet is still rigid enough to propel the drive, the club head could hit the ball just when its velocity is the maximum.

The present invention devises a way to increase the bending strain energy of the shaft with very little change in the conventional geometry of the club, including shaft size, length, grip, and etc. The invention characterizes in having extra length of tubes disposed approximatgely in parallel, long enough to store strain energy, inside the hollowness of the original shaft. The way to do this is at a point along its axial length, called an insertion point, the shaft is rigidly coupled to a smaller tube, called the intermediate tube, which is disposed, at least partially, inside the original shaft. This smaller tube extends backward, away from the insertion point, for some length, and is then rigidly coupled to an even smaller tube, called the central member, disposed, at least partially, inside the hollowness of the intermediate tube, which reverses the direction and extends forward again towards the insertion point, surpassing the original shaft at the insertion point and extends beyond. The intermediate tube, or tubes, between the original shaft and the central member, and the central member, plus the necessary couplings which connect them, constitute an assembly. The central member is then, beyond the surpassing point, coupled to the downstream length of the original shaft or coupled yet to the next assembly. Details may vary, tubes may be noncircular, partially hollow or partially disposed, in relations to each other, all being understood and allowed for.

Detail of the invention, described with the golf club as an example, but is not limited to the given geometry, is described below.

Figure 4A:
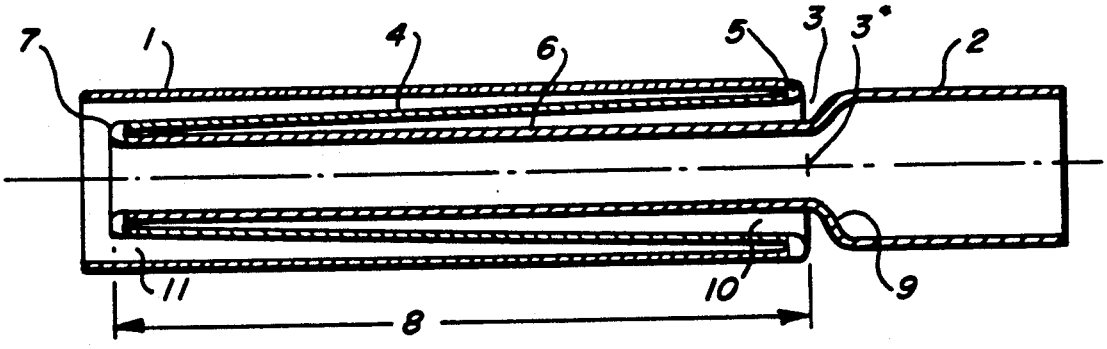
FIGS. 4A, 4B, 4C show embodiments of prefered configurations of an assembly.

FIG. 4A shows a preferred embodiment of the assembly. The shaft up to the insertion point 3 from the left is taken as the upstream original shaft; the portion of that shaft which contains an inside unit labelled as an assembly is called a shaft segment, or segment 1 which is a host tube to its assembly. Segment 2 on the right is the downstream portion of the original shaft. Segments 1 and 2 are not necessary of the same size at the insertion point 3. Either segment may be towards the handle of the shaft. Segment 1 is structurally coupled to an intermediate tube 4 of the assembly through a coupling 5, near the insertion point 3. The coupling 5, and others like 7 and 9 later, may be a bracket, a weld, industrial glue, any other mechanical connecting means, or simply a molded integral joint as is shown in FIG. 4A. The intermediate tube 4 is smaller in size than segment 1. Extending backward from point 3 for some length designated as 8, 4 is coupled to the butt end 7 of a central member 6 of the assembly which may be a solid bar, or a partially or completely hollow tube. After joining with 4 at 7, the central member 6 extends forward again towards the insertion point 3. After overtaking a surpassing point 3*, which is understood as approximately the intersection point between the vertical line passing through 3 and the axis of 6, the member 6 joins with the next assembly or directly with segment 2, by means of a coupling. The coupling may be a bracket, a weld, etc. or a molded neck 9 shown in FIG. 4A. The central member 6 may include the coupling if it is to the left of 3*. Also, the neck 9 may be a part of the segment 2. In later discussions about the merits of the assembly, the point 3 is the end of segment 1 and point 3* 15 the beginning of segment 2. The zig-zaged structural path in between these two points is the current assembly disposed inside the hollowness of segment 1.

If there is no assembly added to the shaft, 3 joins directly with 3* and the slope of the shaft under bending has no increment at that point. If there is an assembly inserted, the angle of inclination of the club shaft at point 3* will be abruptly increased as compared to the angle of inclination at point 3 when the hitting force is applied at the head of the club. With this additional bending, the head will be bent further backward, and more strain energy is added to the shaft. As previously mentioned, maximum head speed will be much larger than the prior art shaft without the inventive assembly.

The length, 8, of the central member 6, and of the tube 4, is important to the flexibility enhancement of the assembly. It may be taken as the approximate length of the assembly under the segment 1. The longer it is, the angle of inclination of the shaft at point 3* relative to that of the shaft at point 3 will be larger, and the overall bending of the shaft will be increased.

Figure 4B:
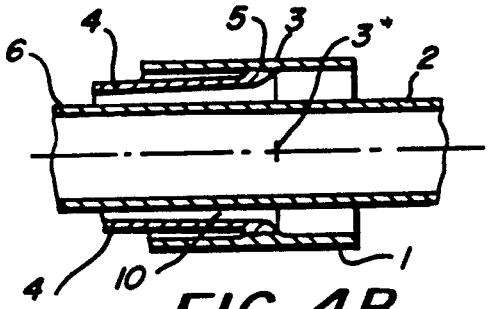

Since the bending moment due to the inertia force at the head is transmitted from tube to tube, whereby each tube will have different lateral movement and curvature change along its length, spaces between 6 and 4 and between 4 to 1 should be provided along the whole path; and in particular, at locations 10 and 11 where the relative lateral movement is the largest. Cushion material may be used in said spaces between neighboring tubes, selectively or completely. When the dimension 8 is long, the required clearance at 10 and 11 will be more, which puts a practical limit to the lengths of 4 and 6. Shaft 1 may extend beyond point 3 for some length as shown in FIG. 4B, but it will not couple with 2.

Figure 4C:
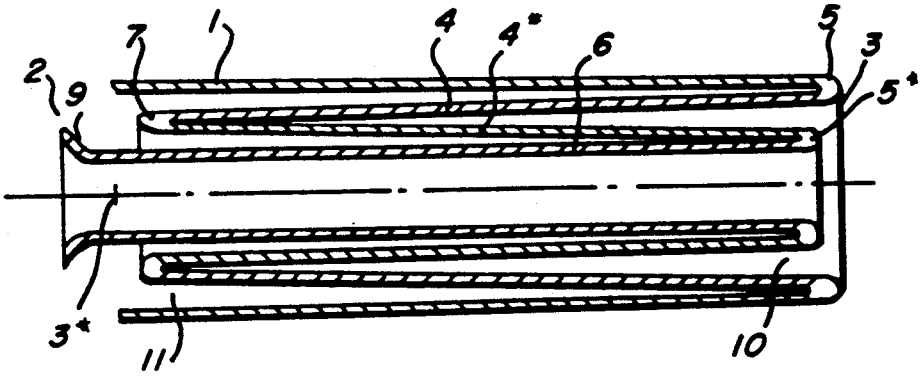

In FIG. 4A only one intermediate tube 4 shown in the assembly. However, more than one such tube may be utilized. In the arrangement having more than one intermediate tube, the first intermediate tube 4 is the largest within the segment 1. A smaller, second intermediate tube connects the first intermediate tube at the first butt end 7, and extends towards point 3. The third intermediate tube, smaller than the second, connects the second intermediate tube at the second coupling 5 near 3. It extends back towards the last butt end 7 to connect the central member 6, which is even smaller. Spaces should be provided among all neighboring tubes. For even numbers of intermediate tubes, such as two as shown in FIG. 4C, where the second intermediate tube 4* and its coupling 5* added, the central member 6 will extend beyond the assembly along the direction opposite to FIG. 4A. Points 3 and 3* will be separated by one assembly's length apart. Of course, segment 1 can still extend beyond as shown in FIG. 4B as an option.

Between the central member 6 and the segment 2 down stream, there may be offered at least two preferred ways to connect a second assembly to the first assembly: central member to central member and central member to the segment tube. Both are feasible and prefered.

Figure 5A:
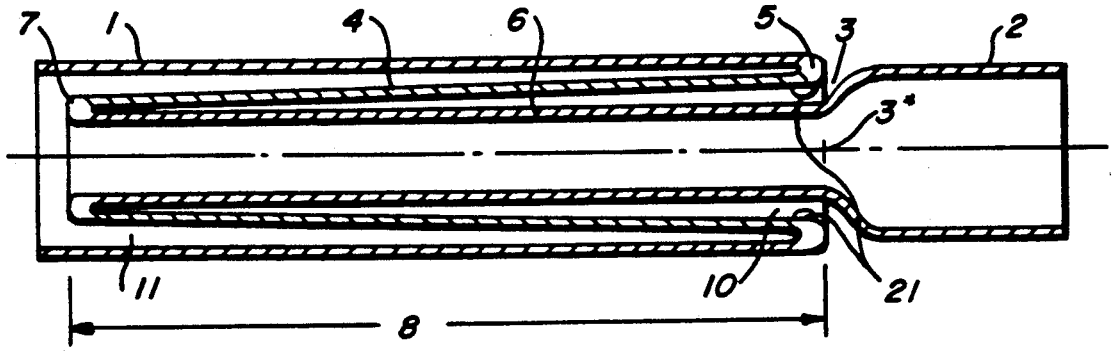
FIGS. 5A and 5B show different embodiments of prefered assemblies.

Another embodiment is shown in FIG. 5A where a pivot device 21 close to the insertion point 3 is made as an integral part of segment 1. This pivot device limits the lateral movement of 6 relative to the wall of segment 1 at that point, but inclination of member 6 with 21 as pivot is still unrestricted. Limiting the lateral movement of 6 at the entrance at the segment 1 adds firmness for the shaft to control the swing. The pivot device 21 may be a ring of the same material as segment 1 with rounded edges to permit rotation of 6 about an axis perpendicular to the axis of the segment 1. Other ways are also feasible. The device may also include a layer of hard rubber, or similar cushion material, or even a small space, between 6 and the unyielding part of the pivot. At the insertion point 3, in the space between the current shaft segment and the next adjacent shaft segment, there may be an insertion material or devices disposed in the gap as shown as 21 later in FIG. 12. It may be a pad, a rubber cushion or other material or devices.

Figure 5B:
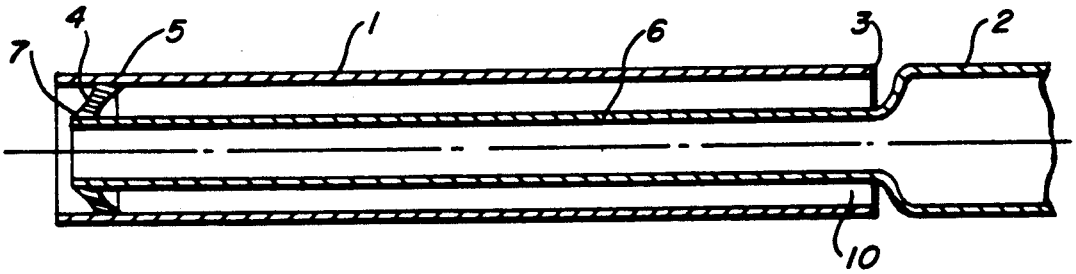

FIG. 5B shows an exceptional case of the assembly applicable only to an end of a shaft of the equipment, its construction does not follow the general characteristics of the invention. In this case, the means for associating the central member 6 to the shaft segment 1 is through a short intermediate tube 4 whose ends 5 and 7 both are very close to the butt end of the central member 6, and direct rigid connections are made between the segment 1 and the central ember 6, respectively, as shown. In another words, 4 is almost eliminated and the butt ends of 1 and 6 are coupled. When it is applied to handles of sports racket, the player is actually holding the outer tube which is the segment 1, leaving the central member 6 extending all the way to the butt end to connect the outer segment there. In that way, the length of the equipment remains the same as before but the entire shaft is now fully used for flexibility, the length of the shaft on which the hand holds is not interfering, or reducing, that function.

In the design with a pivot device like 21 in FIG. 5A, inclination angle of member 6 at point 3* can not be as large as the design in FIG. 4A which has no pivot device. But the invention design, even with the pivot device at 21, will have at least 40% larger angle of inclination at point 3* than that of the segment 1 at the insertion point 3, owing to the additional bending from tubes 6 and 4 inside. For golf clubs, the advantages of having the assembly is probably not fully utilized if the length of the assembly is less than about 5 cm. This will be shown later.

Figure 6:
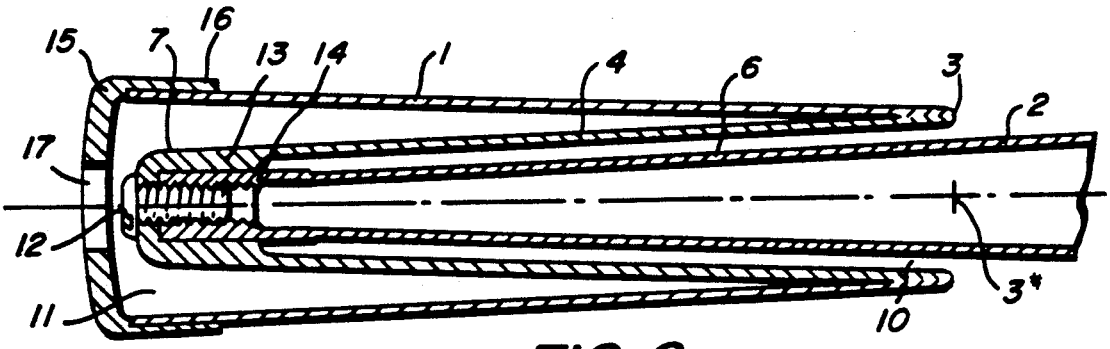
FIG. 6 shows a coupling of the central member with the intermediate tube.

Another embodiment is shown in FIG. 6 where a screw 12 is used to secure the intermediate tube 4 to the central member 6 at their butt end 7 in which the end of 6 enters a tightly fitting housing 13 belonging to 4. The end of 6 at the butt point 7 is having a thicker end 14 with threads to receive the screw 12. Some degree of taperness is prefered at the contact between 4 and 6 at the housing 13 to facilitate the fastening. The cap 15 of the rubber grip 16 could have an opening 17 for access to the screw. In this manner, segment 1 which contains an assembly with tube 4 could become a detachable handle to receive segment 2, which is the downstream portion of the club. Segment 2 may be the same size as member 6 or of a different size. In the drawing it is shown as an extension of the member 6. Assembly butt end 7 may extend outside the butt end of the grip 15. FIG. 6 shows only one way to secure the assembly with the handle to the downstream portion of the shaft, other means are available.

Figure 7:
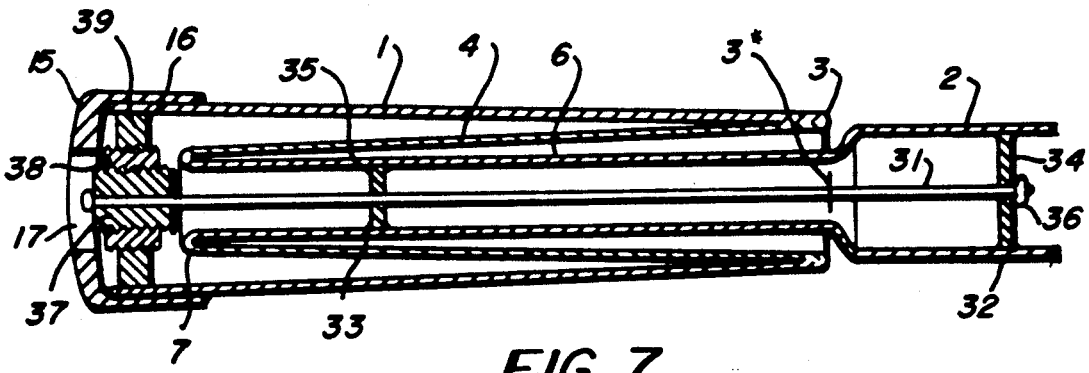
FIG. 7 shows an embodiment of an assembly which contains a pre-tensioned wire.

Another embodiment is shown in FIG. 7 wherein a strong thin wire 31 is used to tie between two end points along the center line of the shaft such as in location 32 which is in segment 2 and in location 33 which is near the end 7 of tube 6. Wire supporting seats 34 and 35, with holes to pass the wire as shown, are fixed in 2 and 6 respectively. One end of the wire 31 is anchored at 36. The other end is anchored at a movable seat device which is cleared with the end 7. The seat device consists of an inner seat 37 which anchors the wire, an intermediate screw 38 and an outer screw 39 which is fixed about the end of segment 1. When screw 38 is turned, the inner seat 37 can be made to advance towards either direction along its axis. In this way, the wire can be tightened to the desired tension. Access hole 16 is provided in the cap so that the wire 31 can be tightened with the grip on. The hole in the support 35 should be made snug with respect to the wire. When the segment 2 is bent under the inertia load, 6 will be displaced laterally with respect to the wall of the segment 1. The supporting seat 35 will press against the tightened wire which is anchored at the inner seat 37. Consequently, the lateral movement of the butt end 7 of member 6 with respect to segment 1 will be restrained by the tensioned wire. This will further aid the bending of the central member 6. Of course, other types of mechanical means can be used to adjust the tension of the wire.

The following will show how the inventive assembly increases the drive range of the golf club.

Figure 8A:
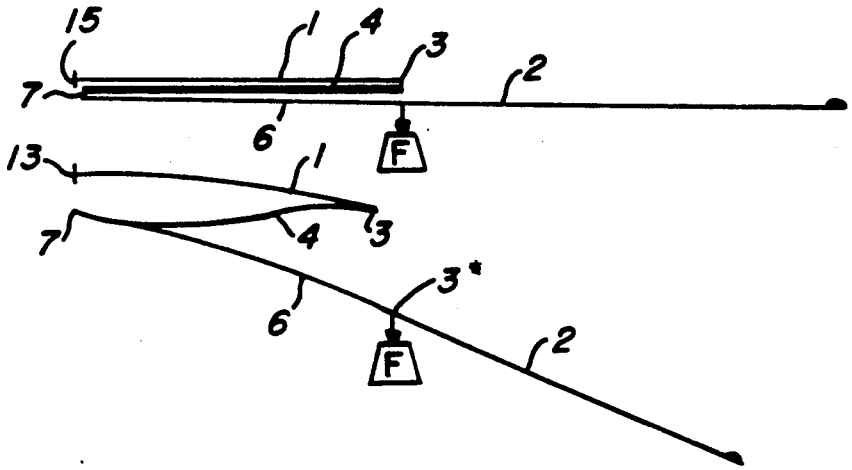
FIGS. 8A, 8B show bending of a conventional club and a club with the assembly installed.
Figure 8B:
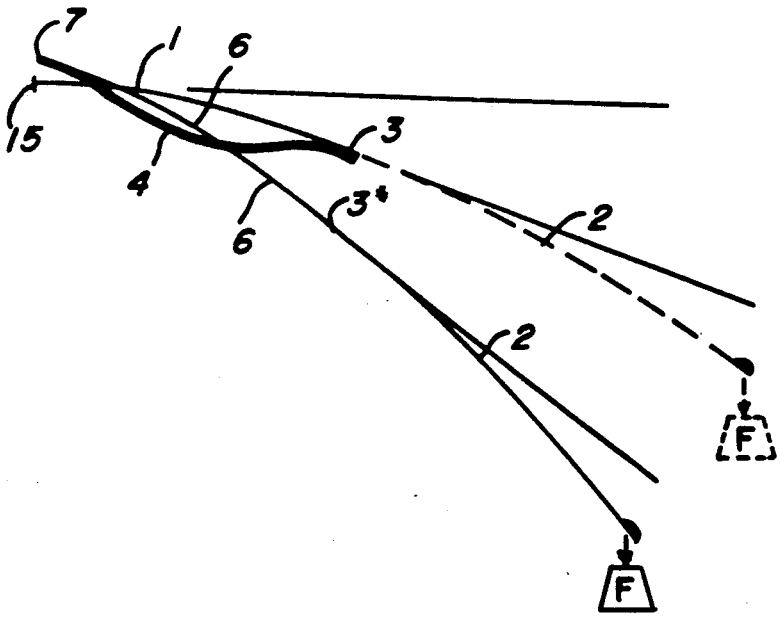

FIGS. 8A and 8B show the center lines of the three tubes 1, 4 and 6, of FIG. 4A. The bending of the shaft caused by the inertia force F at the head is much exagerated for clarity. All lateral movements of the assembly should be contained within the hollow of the segment 1. If the inertia force F is applied at the insertion point 3, the bending curve will look like FIG. 8A where the butt end 7 is dropped below the end point 15 of the handle. If F is at the club head as shown in FIG. 8B, point 7 will be deflected above point 15 due to the large bending moment about point 3* from the load, which bends member 6 upward like a pole vault under bending using point 3* as a pivot. All these are derived from analysis. The three tubes 1, 4, and 6 in FIG. 8A are like three bellows of an accordion. The coupling points of the bellows of the accordian such as 3 and 7, move laterally and also rotate along the direction of bending. It is the rotation that really has significant effect on the travel of the head of the golf club because of the long arm between the head and the fulcrum point 3*. If there is no assembly inserted, point 7 will be the root, the angle of inclination of 7 would be zero, and the deflection of the shaft would be the one shown by the dotted line in FIG. 8B. That the solid deflection line in FIG. 8B can have a much larger deflection is due primary to the added inclination angle at point 3* which is about three times the angle of inclination of the same point 3 of segment 1 in the dotted line.

Figure 9:
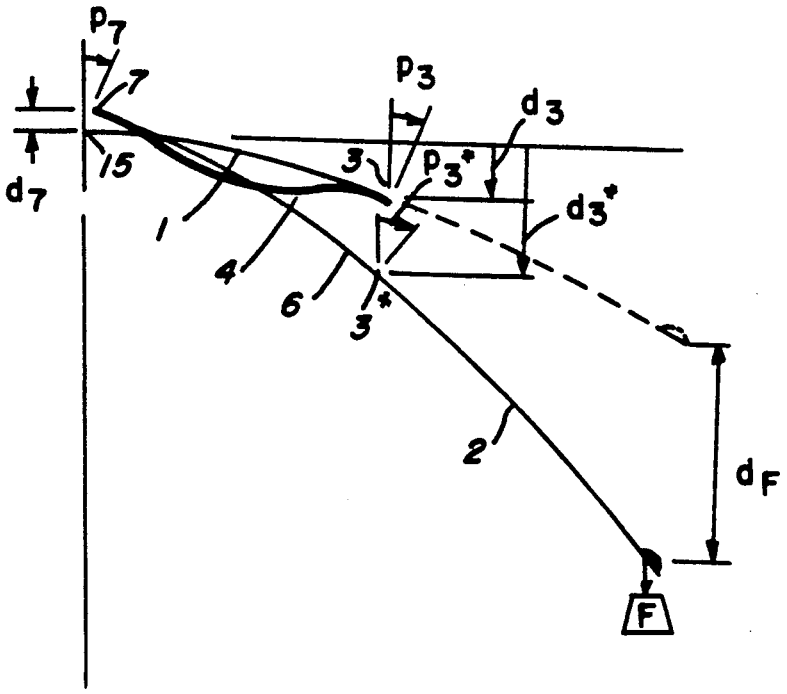
FIG. 9 shows lateral displacement and angle of inclination at locations 3, 7 and 3* of the shaft with the assembly.

FIG. 9 is taken from FIG. 8B. A deflection analysis has performed on the shaft in FIG. 8B with a force F applied at the head. The bending stiffness of the segment 1, tubes 4 and 6 are all having the same bending stiffness value D, where $D=3.1416\times E\times(d_o^4-d_i^4)/64$, where E is the shaft's Young's modulus, which for steel, is $E=2.113\times 106$ Kg/cm$^2$. At the handle of the shaft in FIG. 1, the shaft outside diameter $d_o$ is 1.5 cm and the inside diameter $d_i$ is 1.43 cm. which yields the stiffness $D=91{,}367$ Kg-cm$^2$. Analysis shows the following deflections (labelled as d) and the angle of inclinations (labeled as p) at the insertion point 3 ($d_3$, $p_3$) of the segment 1, at the butt end 7 of the longitudinal member 6 ($d_7$, $p_7$) and at the surpassing point 3* of the segment 2 ($d_3^*$, $p_3^*$), all are shown in Table 1:

TABLE 1

| FIG. 9 | |
|---|---|
| $d_3$, downward, $= (Fb^3/D)(0.5N - 0.17)$, | $p_3 = (Fb^2/D)(N + 0.5)$ |
| $d_7$, upward, $= -1.0(Fb^3/D)(N - 1.66)$, | $p_7 = 2 \times p_3$ |
| $d_3^*$, downward, $= 3 \times d_3$, | $p_3^* = 3 \times p_3$ |

where b is the length of the central member 6 (8 in FIG. 4), and N is an integer which is obtained by having the length of the remaining shaft from 3* to the head divided by the central member length b. The distance $d_F$ in FIG. 9 is the additional displacement of the head due to the slope increase at point 3*. $d_F=Nb\times(p_3^*-p_3)$. Table 1 and $d_F$ will be used later in a discussion using Table 2.

From Table 1, we see that the additional angular inclination at the location point 3*, having the assemby, is two times. This additional angular inclination will produce considerably more work done by the inertia force at the head which will be transformed later for additional velocity to the head. Example of merit will be described below.

The conventional, tapered steel golf club as shown in FIG. 1 has a constant wall thickness of t=0.036 cm, and a variable outside diameter given by the equation:

$$d_o(X)=0.8+0.00714X \text{ cm.}$$

where X is the distance measured from the end near the club head.

Its bending stiffness D is a function of X too, given by $$D(X)=\text{shaft bending rigidity}=(3.1416/8)\times E\times t(0.8+0.00714X)^3$$

where $E=2{,}113\times10^6$ kg/cm$^2$ for steel, and t=wall thickness=0.036 cm.

A very complicated large rotation dynamic analysis, a state of the art in dynamics of elastic beam, is completed to study the given golf club in its swinging action from an overhead position until the head reaches the ground level. Taperness of the shaft, its variable mass distribution, and the eccentricity of the head relative to the club shaft, are all taken into account in the analysis. In one version, the club has the geometry exactly as is shown in FIG. 1. In another version, an assembly of a length b=10 cm, with bending rigidity D the same as the butt end of the shaft, is incorporated into the handle. In another word, it is a comparison of a conventional golf club compared with the same club having one inventive assembly of length 10 cm. installed inside the handle.

Figure 10A:
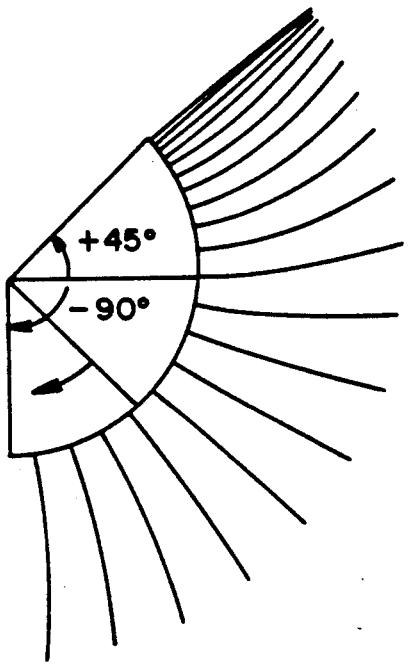
FIGS. 10A, 10B show the computer program results of curved shapes of the clubs in their trajectory.
Figure 10B:
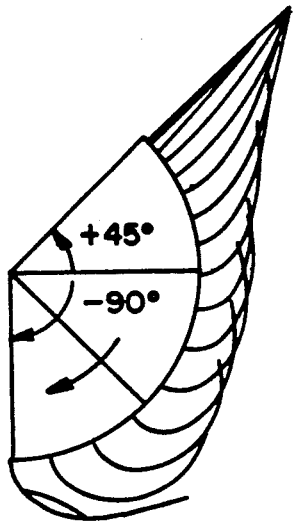

FIG. 10A shows the true bent shapes of the FIG. 1 club, without the assmbly, at different positions of the trajectory. The first top deflection curve of the club in FIG. 10A is straight, then it is progressively bent backward as it is being swung downward due to the inertia force at the head. Then it begins to straighten up and finally it even bends forward. The maximum speed of 2600 cm/sec. is reached at the −30 degree position, after 0.23 seconds when the shaft is becoming straight. The inertia force at the head at that instant is the maximum: F=5.7 kg. It should be noted that the head is bent the most backward at 23 degree position with the head deflected back of 35.0 cm, but the head speed at that most deflected back position is only 1,187 cm/sec. Afterwards, the head is racing forward by the periodic motion of the shaft and the bending energy is completely turned to kinetic energy at the time when the shaft is becoming straight (at the −30 degree position) with head speed becoming 2,600 cm/sec.. That the flexibility of the shaft really helps to achieve higher head speed is very clear. However, if the shaft is too flexbible, it will not recover straightness in time. The period of vibration of the soft shaft is too large. Such is the case shown in FIG. 10B. FIG. 10B shows the deflected shape of the club in its trajectory where the tapered shaft of FIG. 1 is replaced by an elastic, solid, straight rod of 5.0 mm constant diameter with the same weight. Its bending stiffness is greatly reduced. It shows the shaft is too soft: the handle has completed its travel along the trajectory wherein the head is still lagging way behind. FIG. 10A and 10B demonstrated that the flexibility of a golf club has to be optimally designed and a golfer's timing and coordination are equally important to a successful drive.

Figure 11:
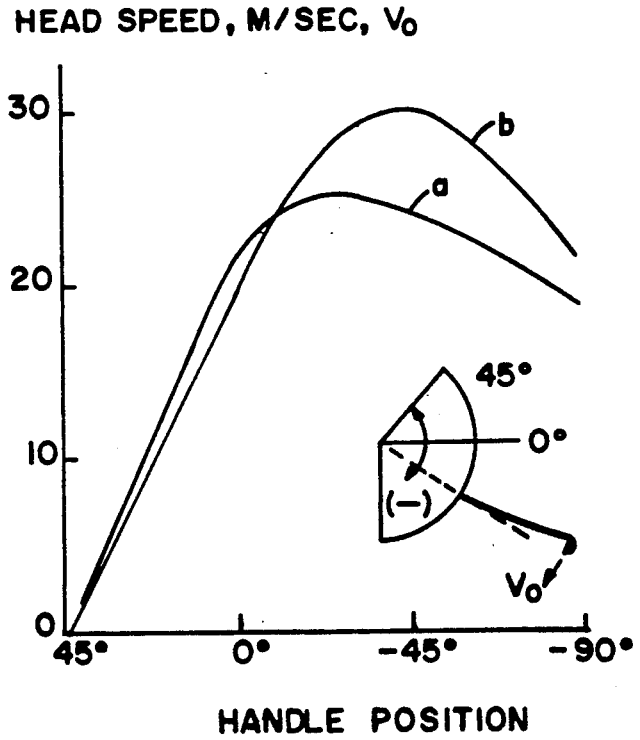
FIG. 11 shows the head speed versus the handle position for the conventional club and for the inventive club.

FIG. 11 compares the FIG. 1 club with and without an assembly of 10 cm long. Curve a is without the assembly, from the trajectory as shown in FIG. 10A, and curve b is with the assembly installed, all other factors being equal. The maximum head speed for curve b is 29.4 m/sec. while for curve a, as said before, the speed is only 26.0 m/sec. This 13% increase in the head speed is due to the installed assembly. Based on Eq. (10), the distance of drive of the ball is proportional to the speed of the head squared. The 13% increase in head speed will increase the drive distance of the ball by 27% ($1.13^2-1=0.27$). The orignal club is calculated as having a drive distance of 275 m. The club with the 10 centimeter assembly installed will have a drive distance, 27% more, to 353 m.

Figure 12:
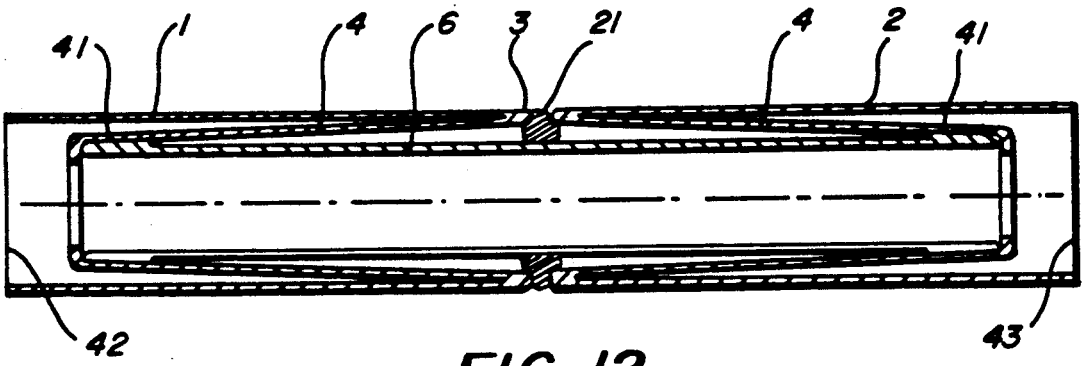
FIG. 12 shows two assemblies coupled through a common central member.

FIG. 12 shows a more preferred embodiment wherein the two assemblies share, or are joined together as, a common central member 6, each having its own intermediate tube 4. Coupling of segments with their intermediate tubes may be made by casting or molding integrally or joined by other ordinary attachment means, such as industrial glue or threads at interface 41. Segment 1 and tube 4 in each assembly may be molded integrally, or individually. Before the two subunits are joined by member 6, a cushion ring 21, or other substance or device, may be inserted in the joint as shown in FIG. 5. An an option.

The invention can be applied to detachable golf club handles. FIG. 4A may be such a detachable handle. Segment 2 may be shaped to be ready to receive the butt end of the shaft of the club, coupled to the shaft by glue, by thread, or by other means. The shaft may also extend into the assembly to make a ready coupling. In that case, the length of member 6 may be very short and the coupling may take place anywhere between the butt end 7 and the point 3*. Another embodiment is using FIG. 4C handle with two intermediate tubes. End 3 is the butt end of the rubber grip which covers the entire handle. Coupling of the shaft to the handle may take place beyond point 3*, or the shaft may extend into the assembly and be coupled with a short central member 6 anywhere between 5* to 3*, or without the central member 6, coupled directly with tube 4* at the butt end 5*. A detachable club handle may contain more than one assembly. A preferred embodiment includes two assemblies, as shown in FIG. 12. End 42 may be the butt end of the grip and end 43 may be is the open end ready to receive the original shaft of the club. In describing an assembly in the shaft segment for detachable club handles, the assembly may or may not include a central member. The shaft of the club may extend into the assembly to replace the central member. It is understood that: numbers of assembly may be more than one; number of intermediate tubes in an assembly may also be more than one; either the central member, or the shaft segment may be the open end to receive the shaft of the club; and the central member may extend out of the assembly, or the shaft extend into the assembly to be coupled with the assembly; and coupling be made with or without an adaptor which will be explained below. All these are practically feasible and are understood as within the scope of the invention.

Figure 13:
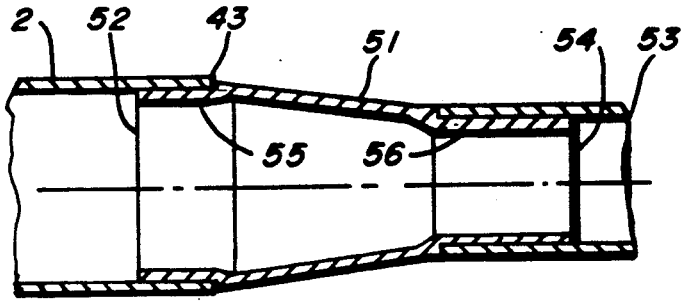
FIG. 13 shows an adaptor.

Such a self-sufficient handle may be offered as a standard equipment. A pro shop may have a large selection of simple tubular adaptors which has one end to be coupled to the standard end 43 and the other end fits a particular golf club. FIG. 13 shows such an adaptor 51 which joins segment 2 at one end 52 and joins the other segment 53 at its other end 54. Interfaces 55 and 56 may be glued or joined tightly by threads. Other ordinary coupling means may be used. End 52 of the adaptor may have one while the size to fit the standard handle 43;

size of the other end 54 should have a wide selction to fit different brands of golf club shafts. Other sports equipment may also use the same arrangement.

It is to be mentioned that a central pre-tensioned wire as described in FIG. 7 may be installed in the assembly described in FIG. 12. Wire end 36 may be anchored at the inside of the adaptor 51 in FIG. 13 with its location 32 anywhere within the length of 52. The other end of the wire may be in segment 1 near the butt end of of the handle, similar in arrangement of FIG. 7. Wire tension can be adjusted through the opening in the cap near the butt end of the grip. Seat 33 may be movable along the axis.

Figure 14:
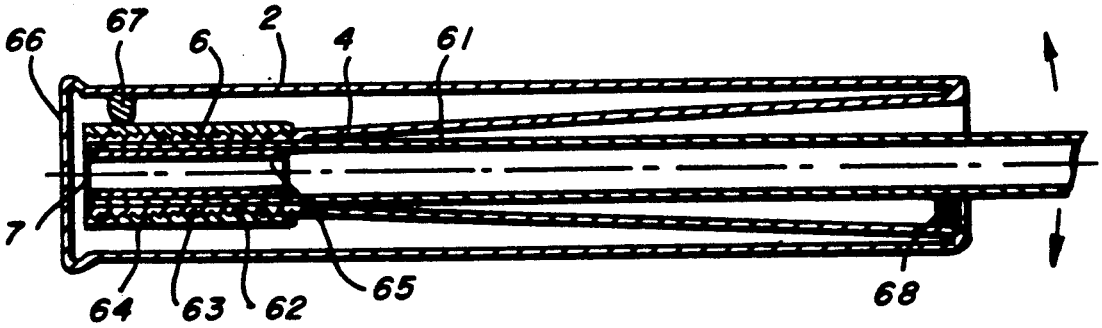
FIG. 14 shows a prefered restorable spare handle.

Another preferred embodiment of an adaptable spare handle is shown in FIG. 14. The central member 6 of the spare handle is short which slides tightly over the original club handle 61. The butt end 7 of the central member is preferred to have threads 62 at its outer surface. The end 63 may be tapered and split with slits (not shown) parallel to the axis of the shaft, so that when the sleeve 64 is turned and advances towards the interior of the central member 6, the diameter at the end is reduced due to the taperness and the slits. Consequently, the sleeve 64 is now pressed tightly against the club handle 61 and a very tight joint is made over a length of the butt end 7. The butt end 7 may be exposed outside the spare handle or a rubber end cap 66 may be fitted at the end of the spare handle. Such a spare handle is easily removable. Stoppers 67 and 68 will be discussed below.

Another merit for the invention is that if it is desired that the end displacement (the throw back of the head during the drive) remains the same as the previous club without the assembly, then the shaft with assembly could be made stiffer, and bent less, but still has the same drive range. The merit lies in the fact that the prior art clubs bend excessively in the lower part near the head, but very little near the handle. This causes the head to flutter and difficult to control, especially to golfers who are not used to the narrow-necked graphite clubs of recent types. The inventive club can be made stiffer and so as to bend less and still provide the same drive range. This is an important advantage.

Figure 15:
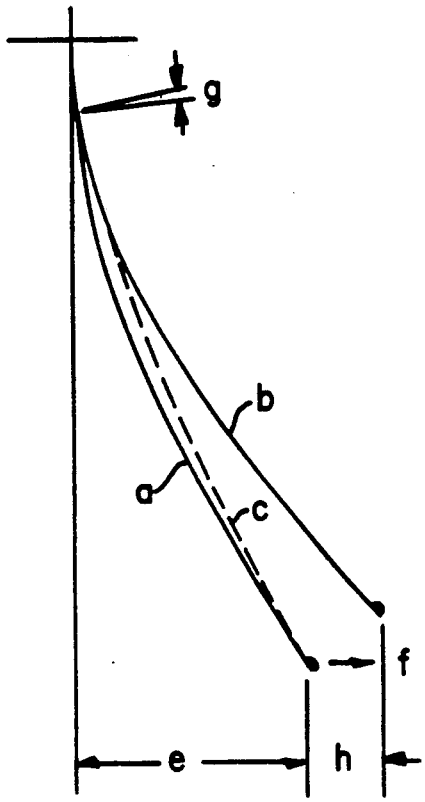
FIG. 15 shows bending curves of shafts.

FIG. 15 shows the results of the dynamic analysis of maximum deflection and the inertia force at the head. Curve a is the computer calculated bending curve of the conventional club of FIG. 1 at its maximum curved shape when the strain energy stored in the club shaft reaches the maximum and the inertia force from the head is also maximum. The end displacement is 35.1 cm and the inertia head force is 5.7 kg. Curve b is the FIG. 1 shaft having an assembly of length 10 cm (b in Table 1 is of 10 cm, N is 9, because the total length of the shaft is $10\times b$, so $N=10-1=9$). The additional angle of inclination at the point 3* of FIG. 9 for this curve is 7.3 degrees which is shown in FIG. 15. This is obtained from Table 1: $p_3^*-p_3=2\times p_3=2\times(Fb^2/D)\ (N+0.5)$, where $F=6.1$ kg, $b=10$ cm, $D=91{,}367$ kg/cm$^2$, $N=9$. Therefore, $p_3^*-p_3=0.127$ radian$=7.3$ degrees. The additional deflection of the head due to this additional inclination angle at point 3* is then $0.127\times 90$ cm$=11.4$ cm. This agrees reasonably well with the more exact computer results of 9.6 cm as shown in FIG. 15. Curve c in FIG. 15 is the FIG. 1 shaft with its taper reduced to make the shaft more stiff. With the assembly installed, the maximum back deflection of the head remains at 35 cm. These three curves are plotted from the computer printout and their bent shapes are accurate. It can be seen that curve c has much less bend in the middle and the club should have better control.

For golf clubs, with shaft diameter $D_o$ not more than 2.0 cm and length L less than 100 cm, a preferred minimum assembly length b is estimated as follows. Since N in Table 1 ($N=L/b$) is a large integer compared with 1, the fractions in the quantities in Table 1 are dropped and the following Table 2 has been prepared:

TABLE 2

| (FIG. 9 reference) | |
|---|---|
| Minimum b, based on clearance at butt end 7, = | $((D/FL)\times \text{Clearance})^{\frac{1}{2}}$ |
| Minimum b, based on clearance at insertion point 3, = | $((D/F)\times \text{Clearance})^{\frac{1}{2}}$ |
| Min. b, based on additional head displacement, = | $(D/2FL^2)\times \text{Displacement}$ |

The third minimum b yields the smallest value and hence is not a candidate. b from the first and the second lines in Table 2 depend on the minimum clearance in locations 10 and 11 (FIG. 4A) that the design should maintain. To get the minimum design length of the assmbly, the stiffness D of the shaft and the CLEARANCE should use the larger estimated values, and the inertia force F the smaller estimated value. For the shaft of FIG. 1, $D=91{,}367$ kg-cm$^2$, $F=6.1$ kg. $L=100$ cm. The minimum clearance in FIG. 4 at points 10 and 11 is 0.2 cm, the minimum assembly length b is then 5.5 cm. Based on the discussion, a preferred minimum assembly length of golf club application is about 5 cm. At that length, the additional head travel obtained is 7.3 cm based on the third formula in Table 2. Further preferred length is about 9 cm. Preferred maximum number of assemblies in the handle is not more than 2 which yields a handle length of about 20 cm to accommodate the two assemblies. Using assembly which is less than the minimum length, benefit would not be significant.

For the assembly as shown in FIG. 5A where a pivot device 21 is employed, the compressive stress imposed on the tube near the pivot point due to the bending moment at that cross section would be prohibitively high if the assembly length 8 is short, because this lenth 8 is the moment arm by which the compressive force at the pivot is developed due to the moment. When the length of the moment arm is zero, the force becomes infinite.

For the assembly which does not need to be axi-symmetric in its physical properties, different bending stiffness may be allowed in the two principal axes, defined in ususal mechanics text, passing through the center of the cross section, making them orthotropic in their physical properties. This can be accomplished by modifying the cross sectional shape to non-circular and by orthotropicizing the Young's modulus, such as manipulating fiber orientation angle in fiber-reinforced materials. With this in mind, referring back at FIG. 4A will show, not as all circular tubings, but as a rectangular tube assembly. Tubes 4 and 6 may have greater height than width so that they are stiffer about one axis than the other. Such assembly is preferred to be used with a rectangular host frame, meaning segment 1 and 2, which prefers to bend about a particular axis. For the same reason, a smaller tube may not be entirely enclosed by the larger tube on all four sides.

Figure 16:
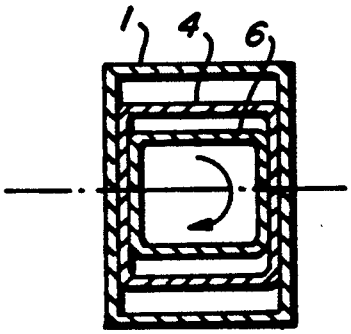
FIG. 16 shows a cross section with restricted freedom of movement.

FIG. 16 shows a sectional view of the FIG. 4A assembly in which all three tubes are rectangular with enough space in between upper and lower walls of adjacent rectangular tubes to allow free bending movement vertically, but only a little clearance is provided between their side walls so that when segment 2 transmits a twisting torque as shown by the arrow in FIG. 16, all three tubes, 1, 4, and 6 will resist the torque, but a bending in the vertical plane containing the longitudinal axis would be freely transmitted from tube to tube as the invention intended. In general, the members of the assembly can be designed to allow structural deflection, or deflections, along one direction, or more, but restrict the rest. FIG. 16 is one example. Another example is In FIG. 14 where 67 and 68 are two stoppers, made of hard material or hard rubber placed as shown in the opposite locations which will allow bending in upward direction but not at the opposite direction. The flexibility in design to allow such control options is one of the important merits of the invention.

Various other modifications that would occur to a skilled workman in the field may be assumed to come within the scope of the following claims.

What is claimed is:

1. A sports equipment having a handle and a shaft extending along the length thereof from the butt end of the handle and wherein there is at least one shaft segment that is at least partially hollow, has an insertion point and includes an assembly, wherein the assembly comprises:

a. a central member, at least partially disposed within the hollow portion of the shaft segment through the insertion point of the shaft segment, wherein the central member is associated with the portion of the sports equipment disposed beyond the insertion point, and there is provided sufficient spacing around at least a portion of the central member disposed within the hollow portion of the shaft segment to allow lateral movement of at least a portion of the central member relative to the shaft segment during bending of the shaft; and b. means for associating the central member to the shaft segment, said means being coupled to the end of said shaft segment opposite to said insertion point.

2. A golf club handle detachable from a club shaft and at least one shaft segment wherein the segment is at least partially hollow has an insertion point and includes an assembly, wherein the assembly comprises:

a. at least one intermediate tube which is at least partially hollow and which is at least partially disposed within the hollow portion of the shaft segment, wherein there is provided sufficient spacing between at least a portion of the intermediate tube and the shaft segment to allow relative lateral movement of at least a portion of the intermediate tube to the shaft segment;

b. a central member at least partially disposed within the hollow portion of the intermediate tube through the insertion point of the shaft segment, and there is provided sufficient spacing between at least a portion of the central member and the intermediate tube to allow relative lateral movement of at least a portion of the central member to the intermediate tube;

c. central member associating means for associating the central member to the intermediate tube wherein the farthest point of the tube from the butt end of the handle is connected to the shaft of the club; and d. intermediate tube associating means for associating the intermediate tube to the shaft segment which is disposed at a location after the central member associating means in the direction toward the insertion point of the shaft segment.

3. A sports equipment having a handle, a head and a shaft connecting the handle and the head, wherein along the length of the sports equipment beginning from the butt end of the handle to the head there is at least one shaft segment that is at least partially hollow, has an insertion point and includes an assembly wherein the assembly comprises:

a. at least one intermediate tube which is at least partially hollow, and which is at least partially disposed within the hollow portion of the shaft segment, wherein there is provided sufficient spacing between at least a portion of the intermediate tube and the shaft segment to allow relative lateral movement of at least a portion of the intermediate tube to the shaft segment during bending of the shaft;

b. a central member at least partially disposed within the hollow portion of the shaft segment through the insertion point of the shaft segment, wherein the central member is associated with the portion of the sports equipment disposed beyond the insertion point, and there is provided sufficient spacing around at least a portion of the central member disposed within the hollow portion of the shaft segment to allow lateral movement of at least a portion of the central member relative to the shaft segment during bending of the shaft and the central member to the intermediate tube during bending of the shaft and arranged wherein at least one of said members is restricted in movement at least along one direction;

c. central member associating means for associating the central member to the intermediate tube; and d. Intermediate tube associating means for associating the intermediate tube to the shaft segment, which is disposed at a location after the central member associating means in the direction towards the insertion point of the shaft segment.

4. The sports equipment according to claim 3 wherein at least one member in an assembly is non-circular in its cross section, whereby the assembly is unrestrained at least in bending deformation in along at least one plane passing through the axis of the assembly, coinciding with one of the principal axes of the cross section.

5. The sports equipment according to claim 3 wherein the central member in at least one assembly can have bending deformation along one direction and is at least partially prevented from bending deformation along the opposite direction.

6. A sports equipment comprising a shaft having a portion adapted for use as a handle by a user, said shaft being formed in an assembly having a first shaft segment formed with at least a partially hollow portion thereof, a second shaft segment, a longitudinal member extending from said second shaft segment, said longitudinal member having a cross section smaller along at least a portion of its length than said first segment, said longitudinal member being at least partially disposed within said hollow portion of said first segment and there is provided sufficient spacing around at least a portion of said longitudinal member to allow lateral movement of said longitudinal member relative to said first segment in said portion during bending of said shaft, and means for detachably connecting the outer end of said longitudinal member to said first segment.

* * * * *